US005236142A

United States Patent [19]

Teranishi et al.

[11] Patent Number: 5,236,142

[45] Date of Patent: Aug. 17, 1993

[54] FEED YARN PACKAGE CONVEYOR SYSTEM IN DOUBLER

[75] Inventors: Junichi Teranishi, Ohtsu; Hiroshi Uchida, Oumihachiman, both of Japan

[73] Assignee: Murata Kikai Kabushiki Kaisha, Kyoto, Japan

[21] Appl. No.: 979,478

[22] Filed: Nov. 20, 1992

Related U.S. Application Data

[63] Continuation of Ser. No. 702,066, May 17, 1991, abandoned.

[30] Foreign Application Priority Data

May 21, 1990 [JP] Japan ..... 2-130623
May 21, 1990 [JP] Japan ..... 2-130624
Jul. 18, 1990 [JP] Japan ..... 2-75579[U]

[51] Int. Cl.[5] ..... B65H 54/00; B65H 47/44
[52] U.S. Cl. ..... 242/42; 198/560
[58] Field of Search ..... 242/355 A, 42; 198/465.1, 560, 561, 359

[56] References Cited

U.S. PATENT DOCUMENTS 3,150,763 9/1964 Immesberger ..... 198/465.1 X
3,794,252 2/1974 Abbott ..... 242/42
3,880,751 4/1975 Wirth ..... 198/359
4,544,107 10/1985 Matsui et al. ..... 242/35.5 A
4,571,931 2/1986 Küpper ..... 242/35.5 A
4,597,540 7/1986 Kiriake ..... 242/35.5 A
4,907,755 3/1990 Burysek et al. ..... 242/35.5 A
4,943,009 7/1990 Gerstner-Stevens et al. ..... 242/42
5,090,635 2/1992 Grecksch ..... 242/35.5 R X
5,097,943 3/1992 Kawasaki et al. ..... 242/35.5 A X

*Primary Examiner*—Daniel P. Stodola
*Assistant Examiner*—Michael R. Mansen
*Attorney, Agent, or Firm*—Spensley Horn Jubas & Lubitz

[57] ABSTRACT

A feed yarn package conveyor system which is capable of automatically conveying feed yarn package to a doubler. It comprises a discharge conveyor and a feed conveyor along the front and rear sides of a machine base; conveyors arranged in two rows on the right and left sides of each spindle, divided to the front and rear; a series of conveyors ranging from the discharge conveyor to the feed conveyor being declined towards the front of the machine base, with the front conveyor on the side of each spindle being set in a take-up position, such that the conveyors will be declined towards a center when feed yarn packages have been received thereat.

13 Claims, 6 Drawing Sheets

FEED YARN PACKAGE CONVEYOR SYSTEM IN DOUBLER

This is a continuation of application Ser. No. 07/702,066 filed on May 17, 1991, now abandoned.

BACKGROUND OF THE INVENTION

The present invention relates to a conveyor system for automatically conveying feed packages to a doubler.

There has been adopted no doubler equipped with an automatic yarn package feeder; in a prior art doublers, the supply of feed yarn package has been manually performed by an operator.

OBJECT AND SUMMARY OF THE INVENTION

It is therefore an object of the present invention to provide an unattended feed package conveyor system which is capable of automatically conveying feed yarn packages to a doubler.

It is another object of the present invention to provide a feed yarn package conveyor system in a doubler which requires no automatic yarn end drawing device.

It is still another object of present invention to provide a lower yarn drawing of a doubler which is capable of easily drawing out the lower yarn from a plurality of feed yarn packages.

To fulfill the aforesaid object the feed yarn package conveyor system in a doubler according to the present invention comprises a discharge conveyor and a feed conveyor along the front and rear sides of a machine base; conveyors arranged in two on the right and left sides of each spindle, divided to the front and rear; a series of conveyors ranging from the discharge conveyor to the feed conveyor being declined towards the front of the machine base, with the front conveyor on the side of each spindle being set in a take-up position, such that the conveyors will be declined towards a center when feed yarn packages have been received thereat; and a swing arm which lowers the front end of the conveyor with the weight of a tray and raises the rear end up to the following course of the tray for receiving and discharging feed yarn packages between the conveyors.

In the feed yarn package conveyor system in the doubler that has the constitution described above, the adjacent sides of two right and left feed yarn packages fed in on the front conveyor on each spindle side section are both in a lowered position. In this position, the yarn is taken up. When the taking-up of the yarn is finished, an empty tray is discharged out onto the discharge conveyor and at the same time a following feed yarn package is received. The movement of these feed yarn packages is smoothly done by means of a series of conveyors including the feed and discharge conveyors which are declined forwardly of the machine base, and a swing arm.

DETAILED DESCRIPTION OF PREFERRED EMBODIMENT

The doubler, unlike a winder, has the following features.

1) Two feed yarn packages per spindle are required.

2) It is necessary to decline the two feed yarn packages toward their center.

Figure 6A:
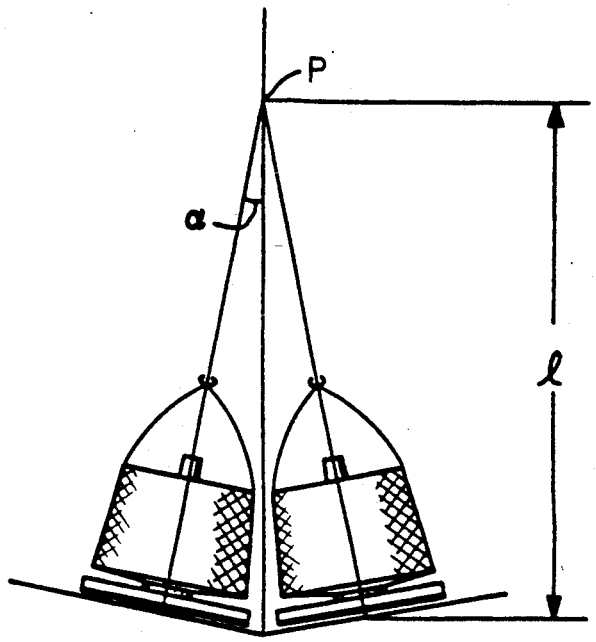
FIG. 6*a* shows feed yarn packages tilted to each other.
Figure 6B:
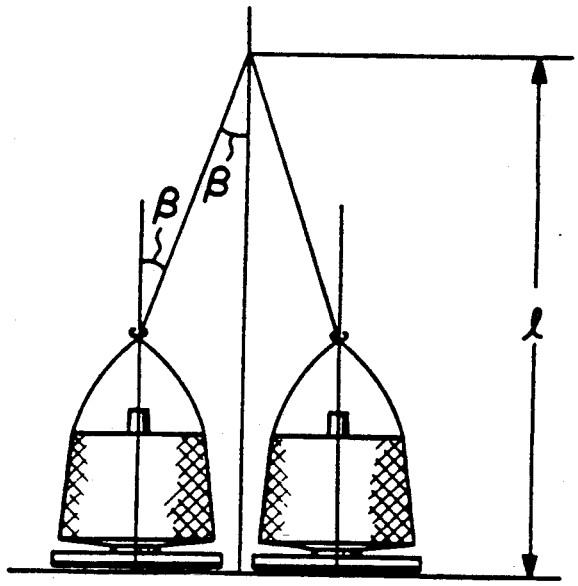
FIG. 6*b* shows feed yarn packages arranged upright.

FIG. 6*a* shows the arrangement of feed yarn packages tilted towards the converging point P. FIG. 6*b* shows the vertical arrangement of the feed yarn packages. Let $\alpha$ and $\beta$ be the angles to the centerline of the yarns fed out, and with the height l from the bottom of the package to a yarn guide set to the same value, $\alpha < \beta$.

In order to increase the take-up speed, it is necessary to decrease the angle of bend of yarns at a yarn guide. Since this angle of bend is also the angle to the centerline of the yarn to be drawn out, a small angle of bend $\alpha$, that is, the arrangement of the feed yarn packages tilted towards the converging point P, shown in FIG. 6*a* is advantageous.

3) Since the doubler uses two feed yarn packages per spindle, a spindle pitch is determined by the size of the package. For example, where a 220 mm-outside diameter package and a 240 mm-outside diameter peg tray are used, the spindle pitch is 510 mm. Because the packages, when conveyed, are required to be placed as close to each other as possible on the conveyor, it is necessary to use a swing arm-type stopper which swings up and down to control the delivery and stop of the feed yarn packages.

The feed yarn package conveyor system has been developed with the above-mentioned kept in mind.

Hereinafter an embodiment thereof will be explained with reference to drawings.

A, B, C, D and E used in the drawings represent the doubling positions of a doubler on a conveyor, and also feed yarn packages present in these positions.

Figure 1:
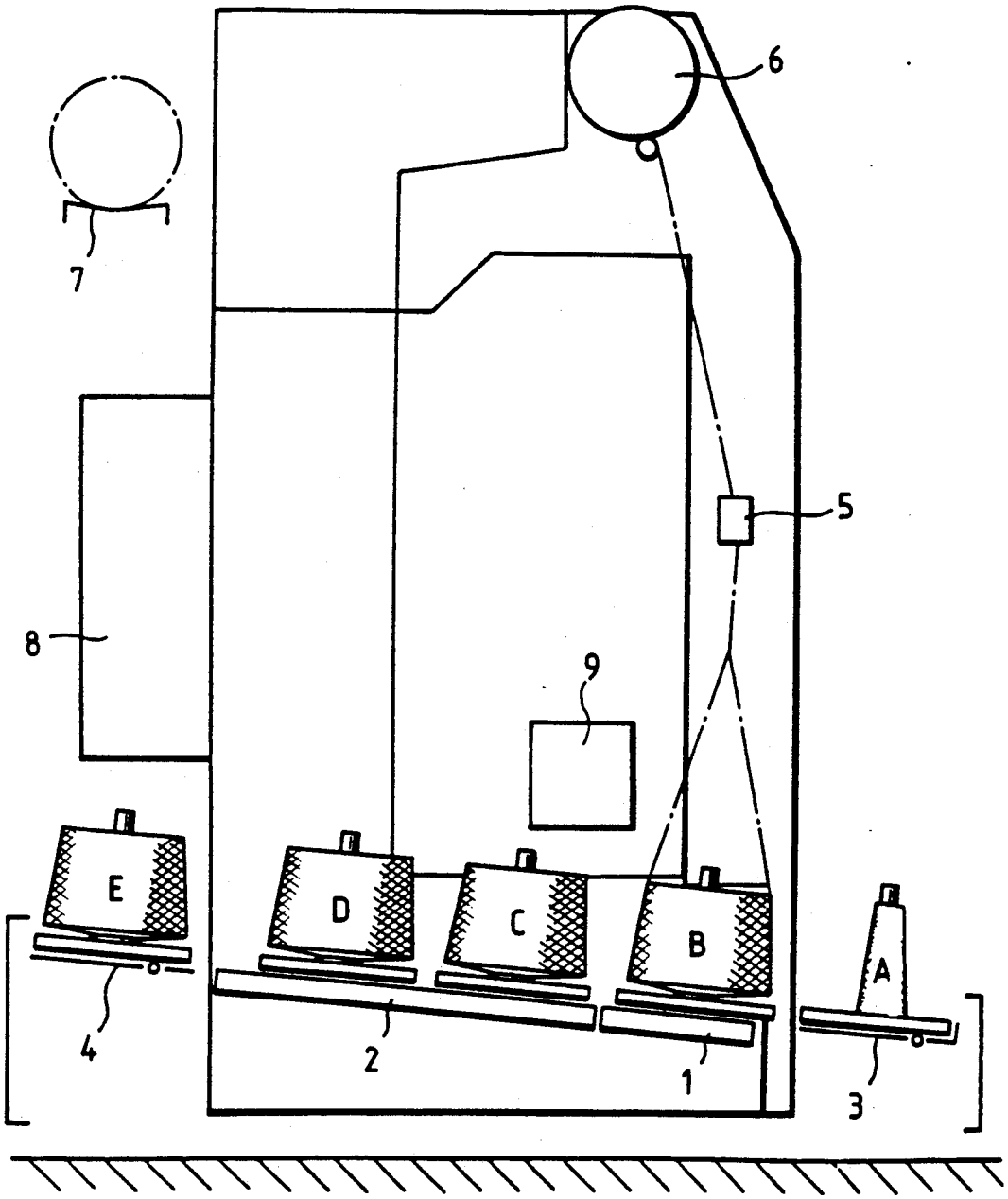
FIG. 1 is a side sectional view of a doubler machine body.

FIG. 1 is a side sectional view of a doubler machine body.

In the direction of depth of this drawing, a plurality of yarn doubling parts are arranged, and on the side of each spindle are installed a spindle-side front conveyor 1 and a spindle-side rear conveyor 2 which are inclined 5 degrees in relation to the floor surface.

At the front and rear sides of the machine base an empty peg tray A conveyor 3 and a feed yarn package E feed conveyor 4 for supplying a package to each spindle are both arranged in the longitudinal direction.

On the spindle-side front conveyor 1 and the spindle-side rear conveyor 2 are placed feed yarn packages B, C and D in two rows.

Yarn is taken up in the B position. Yarn led out from the two packages B goes to the take-up section 6 through a tenser section 5, where the yarn is wound on a take-up package. The take-up package fully wound with yarn will be discharged onto the conveyor 7.

When the yarn has been fully fed out from the package B, the package B is discharged in the state of an empty tray out to the end of the machine by means of the discharge conveyor 3.

The feed yarn packages C and D are therefore in waiting positions. The feed yarn package E comes on the conveyor 4 to the D position from the end of the machine when the package in the D position has advanced into the C position. In this case, the feed yarn package E is fed in with the leading end of the yarn already wound several turns on, and hanging down in, a hollow tube on the peg tray T.

The conveyors 1, 2, 3 and 4 of this conveyor system are inclined at the same angle towards the front of the machine base, and therefore the peg trays of the feed yarn packages A to E are also inclined at the same angle to allow smooth flow of the packages. The spindle-side front conveyor 1 is separate from the spindle-side rear conveyor 2. The spindle-side front conveyor 1 is designed such that two rows of conveyors per spindle can be declined towards the center thereof. Numeral 8 denotes a control box of the doubler, and numeral 9 is a flying yarn waste collector.

Figure 2:
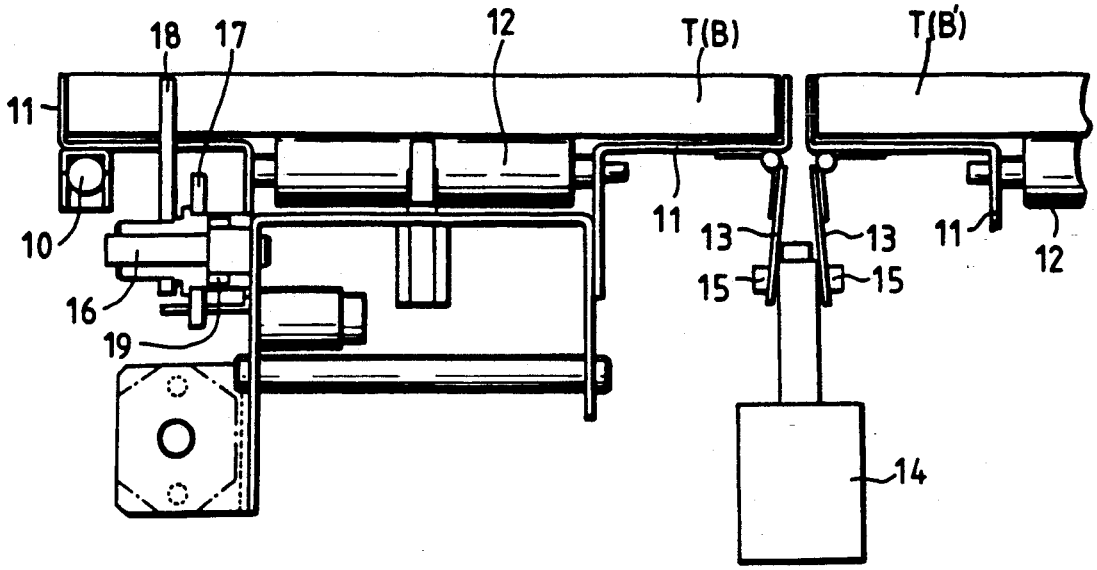
FIG. 2 is a front view of a spindle-side front conveyor as viewed from the front of a machine base.
Figure 3:
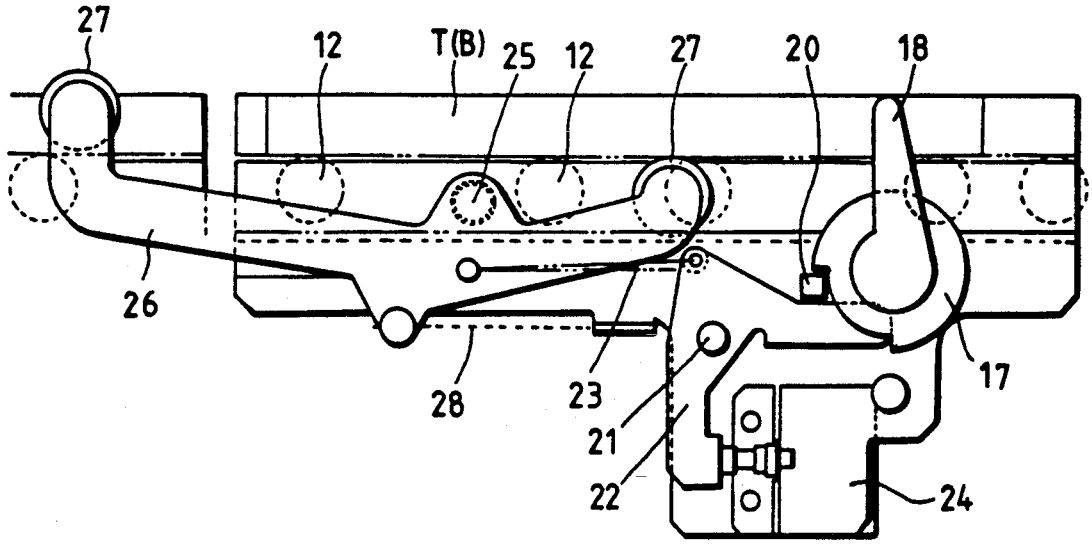
FIG. 3 is a side view of the same.

Next, the spindle-side front conveyor 1 will be explained with reference to FIG. 2 showing the spindle-side front conveyor 1 as viewed from the front of the machine base and to FIG. 3 showing the same conveyor 1 as viewed from the side of the machine base.

A guide plate 11 for guiding the tray T is swingably supported on one side on two shafts 10 which are fixedly mounted on a machine frame along the direction of flow of the tray T. On this guide plate 11 are attached free rollers 12 at appropriate spaces in the direction of flow of the tray T, facilitating smooth travel of the tray T.

On the other side of the guide plate 11 is installed a lock plate 13 by a hinge. Below this lock plate 13 is secured an air cylinder 14. On both sides of the top end of a rod of the air cylinder 14 are provided projecting pins 15, which are engaged each in a hole provided in the bottom end of the lock plate 13.

When the yarn on the feed yarn package B or B' has been all unwound, the rod of the air cylinder 14 goes up as high as the level of the conveyor 2. Then, the empty tray T or T' is discharged onto the discharge conveyor 3. When a new feed yarn package B or B' has been received, the rod of the air cylinder 14 goes down to tilt the feed yarn packages B and B' toward the center of a yarn passage.

On a stopper lever shaft 16 fixedly mounted on the machine frame are rotatably supported a cam 17 and a stop lever 18. Between the stop lever shaft 16 and the cam is installed a weak torsion spring 19 to press the cam 17 in a counterclockwise direction. Commonly, one end of a cutout section of the cam 17 is in contact with a stopper 20. In this state, the stop lever 18 protrudes out over the upper surface of the guide plate 11. The other end of the cutout section of the cam 17 is in contact with one end of a free lever 22 swingably supported on a support shaft 21 of the machine frame. The free lever 22 is pressed by a spring 23 towards engagement with the cam 17. With the other end of this free lever 22 a rod of an air cylinder 24 is engaged. When the feed yarn package B or B' has been fully unwound, the air cylinder 24 will be operated to turn the free lever 22 clockwise around the support shaft 21. At this time the stopper lever 18 under the weight of the tray T, now not supported by the free lever 22, turns clockwise, thus discharging the tray T. After the discharge of the tray T, the cam 17, the stopper lever 18, and the free lever 22 are turned back to their former positions by the force of the torsion spring 19 and the spring 23.

In the meantime, at the upstream side of these mechanisms a swing arm 26 is swingably supported on a support shaft 25 of the machine frame and pressed by a spring 28 in the counterclockwise direction. The swing arm 26 is supported at both ends on ball bearings 27. Usually, the downstream ball bearing 27 is in contact with the lower surface of the tray T of the feed yarn package B, while the upstream ball bearing 27 is in contact with the front end of the tray T of the feed yarn package C. When the tray T of the feed yarn package B is discharged, the swing arm 26 is turned counterclockwise by the force of the spring 28, and accordingly the forward part of the swing arm 26 in contact with the front end of the tray T of the feed yarn package C also lowers. The tray T of the feed yarn package C now not supported goes onto the spindle-side front conveyor 1.

Figure 4:
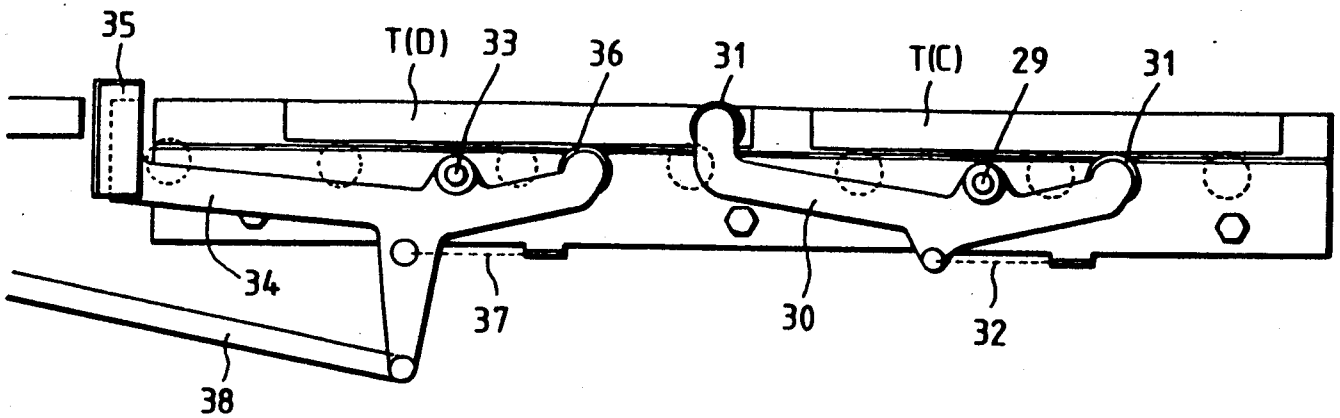
FIG. 4 is a side view of a spindle-side rear conveyor as viewed from the rear of the machine base.

Next, the spindle-side rear conveyor 2 in C and D positions will be described with reference to FIG. 4 which shows the conveyor 2 as viewed from the side of the machine base.

A swing arm 30 is swingably supported on a support shaft of the machine frame and is pressed counterclockwise by a spring 32. On both ends of this swing arm 30 are installed ball bearings 31. This swing arm 30 is identical in construction and function to the swing arm 26 previously explained, and functions to control the discharge of the feed yarn package C and the incoming of the feed yarn package D.

On a support shaft 33 of the machine frame on the upstream side of the swing arm 30 is swingably supported a swing arm 34 having a stopper. This swing arm 34 is pressed by a spring 37 in the counterclockwise direction. A plate-like stopper 35 is attached to the upstream end of the swing arm 34 and a ball bearing 36 on the downstream end. Also, at the bottom end of the swing arm 34 is rotatably installed a connecting rod 38. This swing arm 34 also is much the same in construction as the swing arms 26 and 30 excepting the provision of the plate-like stopper 35 on the upstream end, functioning to control the discharge of the feed yarn package D and the incoming of the feed yarn package E.

The spindle-side rear conveyors 2 also are arranged in two rows per spindle.

Figure 5:
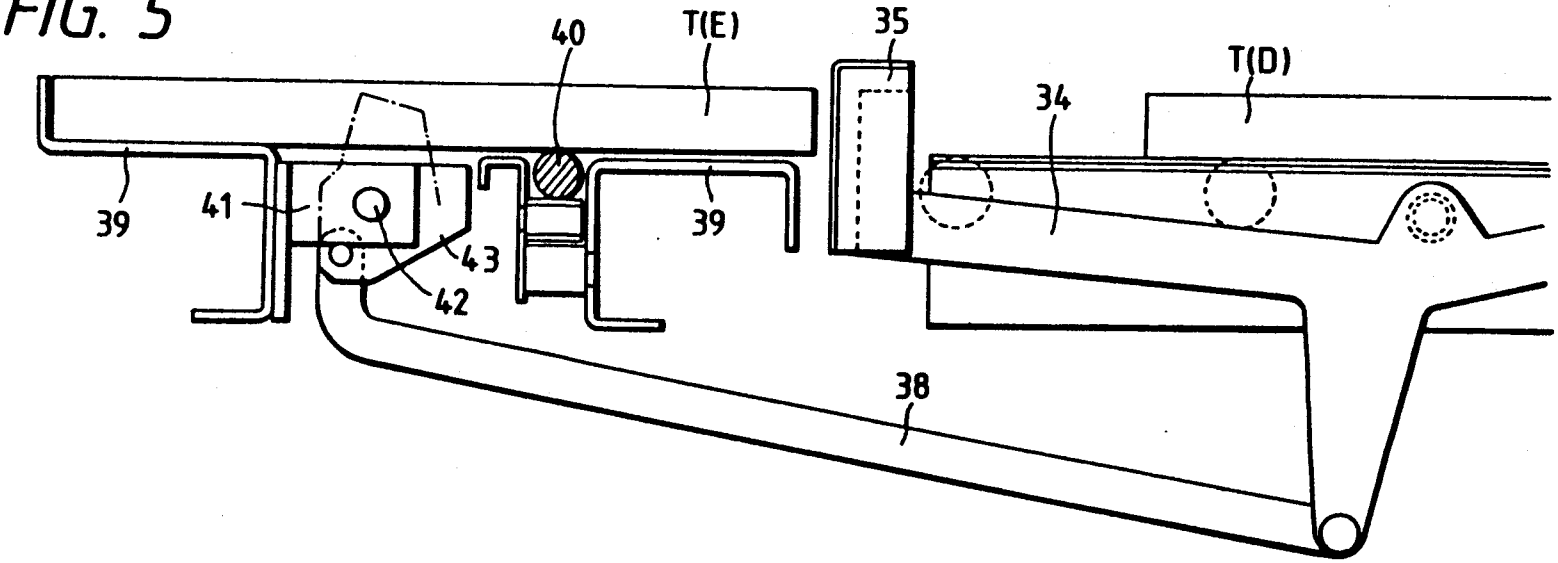
FIG. 5 is a side view a feed conveyor as viewed from the side of the machine base.

Next, the feed yarn conveyor 4 will be explained with reference to FIG. 5 showing the feed yarn conveyor 4 in the E position as viewed from the side of the machine base.

A guide plate 39 is installed extending in the direction of length of the drawing, or the longitudinal direction at the rear part of the machine base. A round belt is movably set in a position close to the spindle-side rear conveyor 2 away from the center of the guide plate 39. This feed yarn conveyor 4 is at a stop when not required; during the period of this stop, the tray T mounted with a feed yarn package is conveyed from the end of the machine base to the E position in accordance with a discharge command produced at the B position, thereby saving an operating power.

Below the guide plate 39 is fixedly mounted a boss 41, and on a support shaft 42 fixedly provided thereon is rotatably supported a stopper 43. On one end of this stopper 43 is supported the other end of the connecting rod 38.

When there is no tray T in the D position, the swing arm 34 swings counterclockwise as described above, pulling the connecting rod 38, which, in turn, allows the stopper 43 to project out above the upper surface of the guide plate 39. A tray T carried in on the conveyor 4 hits the stopper 43 in the E position, being held from advancing further. Then, with the operation of the round belt 40 and the declination of the conveyor 4 towards the conveyor 2 side, the tray T is thrust into the D position.

In order to ensure smooth flow of package, it is desirable that the disk of the tray T for supporting the feed yarn package be provided with a slight downward taper.

The feed yarn package conveyor system according to the present invention, being of the above-described constitution, has the following effect.

Since a series of conveyors ranging from the discharge conveyor to the feed conveyor are declined towards the front of the machine base and thanks to the function of the swing arm, each feed yarn package can smoothly travel, being fed to, and discharged from, each spindle of the doubler without any manual operation.

In the conveyor system described above, the feed yarn package E is carried in on the feed conveyor 4 with the leading end of yarn already drawn out by the automatic yarn end drawing device.

In the following cases, however, the mounting of the automatic yarn end drawing device has not so much advantage.

(1) There can not be secured a space for mounting the automatic yarn end drawing device which is 3 to 4 meters long.

(2) Types of yarns to be handled, such as cotton yarn, wool yarn, blended yarn of polyester and cotton, and filament yarn, change frequently.

(3) There are handled various types of feed yarn packages, such as 3°30′ and 5°57′ paper tube cones and 5-inch wooden bobbin cheeses.

In the above cases, therefore, the feed of yarn packages to the C and E positions is more efficiently done manually by the operator at the E position than automatically by the automatic yarn end drawing device when feed yarn packages have been fed out of the C and D positions.

This operation is not frequently required; it can be performed when yarn on the feed yarn package is going to run out or when the operator has time to do the operation.

Next, a feed yarn package conveyor system in a doubler which requires no automatic yarn end drawing device will be described hereinafter. The feed yarn package conveyor system in a doubler according to this embodiment of the present invention has a conveyor arranged around the machine base and two rows of right and left spindle-side conveyors arranged by the side of each spindle, and furthermore is equipped with a yarn end drawing device connected to a manually-operated suction blower at an appropriate point in the conveyor at the rear of the machine base.

In the feed yarn package conveyor in a doubler that has the constitution described above, when it is found by the operator that no feed yarn package is present in the waiting position of each spindle-side conveyor, a feed yarn package is placed on a tray coming on the feed conveyor by the operator. Then the suction blower is manually operated to lead out the leading end of the yarn on the feed yarn package.

Figure 7:
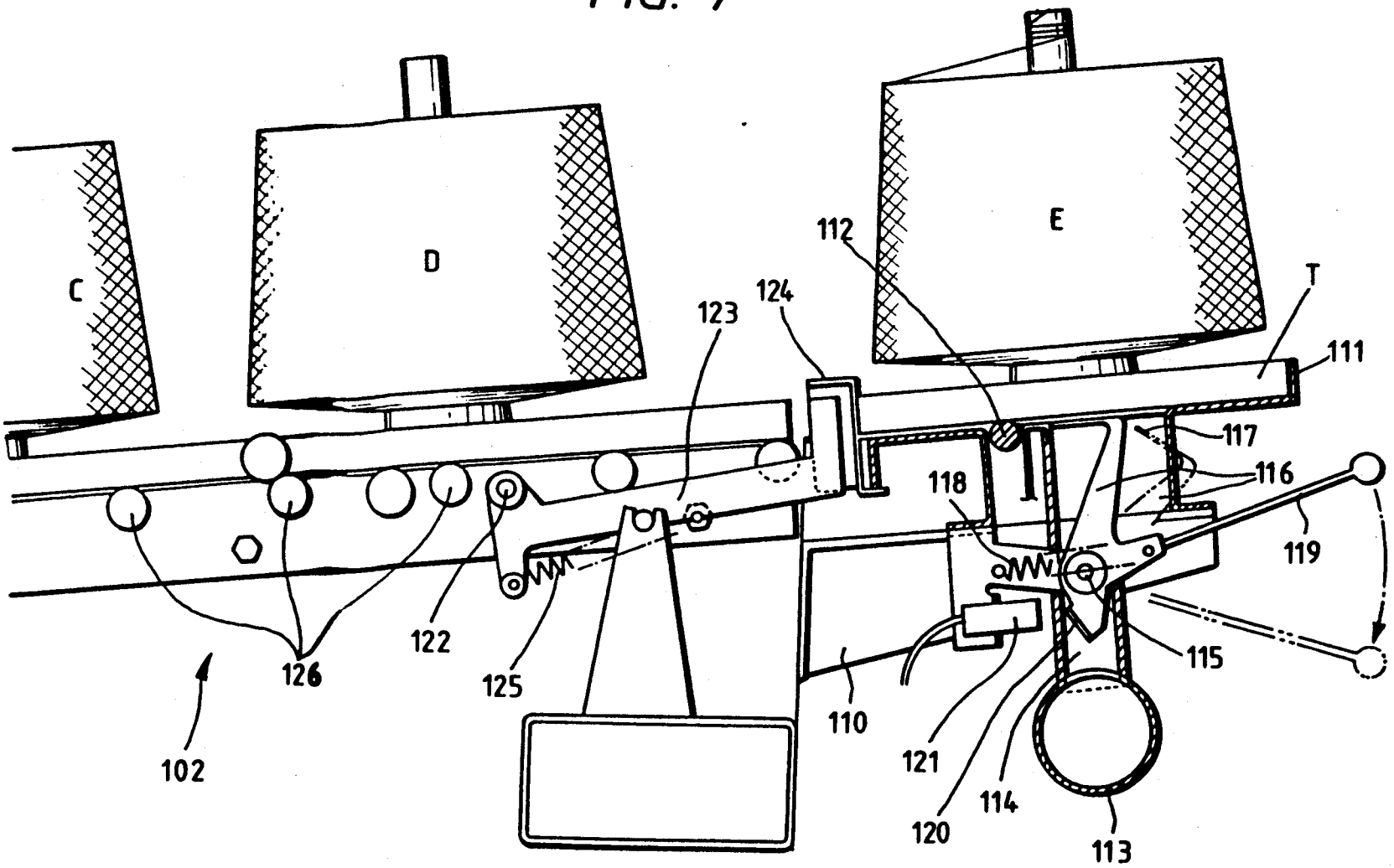
FIG. 7 is a side view of a manually-operated drawing device.

Hereinafter the feed yarn package conveyor system according to the preferred embodiment will be explained with reference to FIGS. 1 and 7.

In this embodiment, a doubler with a conveyor 3 for conveying empty peg trays in place of a feed conveyor 4 shown in FIG. 1 is used conveniently.

In this drawing, A, B, C, D and E represent the positions of the doubler on the conveyor as in FIG. 1, and also feed yarn packages present in these positions.

In the direction of depth of this drawings, a plurality of yarn doubling parts are arranged, and on the side of each spindle are installed a spindle-side front conveyor 1 and a spindle-side rear conveyor 2 which are inclined 5 degrees in relation to the floor surface.

Furthermore, around the machine base is arranged a feed conveyor 3 as described above.

On the spindle-side front conveyor 1 and the spindle-side rear conveyor 2 are placed feed yarn packages B, C and D each in two rows.

Taking-up of the yarn is performed in the B position. The yarn led out from the two feed yarn packages B goes up via the tenser section 5 to the take-up section 6, where the yarn is taken up on a take-up package. The take-up package thus fully wound with the yarn will be discharged out onto the conveyor 7.

An empty tray that has been discharged out from the B position to the A position goes around the machine base to the E position. The feed yarn packages C and D are waiting packages.

Since the conveyors 1, 2 and 3 are inclined at the same angle towards the front of the machine base, the peg trays of the feed yarn packages A to E are also inclined at the same angle, allowing smooth flow of the packages.

The spindle-side front conveyor 1 is separated from the spindle-side rear conveyor 2, and is so designed that the two rows of conveyors per spindle can be declined towards a center.

The receiving and discharge of these feed yarn packages between the conveyors are performed by a swing arm (not illustrated) which lowers at the front end with the weight of the tray and rises at the rear end up to the following tray course.

The operator pulls off a bobbin from an empty tray that has come around the machine base to the E position, and inserts a new feed yarn package to the tray. Then, the operator takes out the leading end of the yarn on the feed yarn package, winds it 3 to 4 turns around on the top end of the peg tray, and puts the leading end into the hole of the peg tray. Subsequently, he performs the drawing operation at the manual drawing device located under the conveyor 3 at the rear of the spindle-side conveyors 1 and 2.

Here the manual drawing device will be explained with reference to FIG. 7.

On a boss 110 of the machine base is attached a guide plate 111 constituting a part of the conveyor 4. In a position close to the spindle-side conveyors 1 and 2 off the center of this guide plate 111, an endless round belt 112 is installed. Furthermore, on the boss 110 are installed a suction pipe 114 connected to a suction pipe 113 through which air is drawn in by a suction blower, and having an opening in the upper part, and a lever 116 which swings on the center of the support shaft 115 with the operation of a handle 119 and has a cover 117 in the upper part which opens and closes the opening of the suction pipe 114. On the lever 116 is installed a spring 118, by which the cover 117 is held closed to close the opening of the suction pipe 116. On the lower bottom of the lever 116 is fixedly attached an iron piece 120, and in the boss 110 located in its vicinity is installed a proximity switch 121 for power supply to a suction blower driving unit.

After the preparation of the feed yarn packages has been finished with the leading end of the yarn wound 3 or 4 turns on the top end portion of the peg tray and inserted in the hole of the tray, the operator will then lower the handle 119, performing the leading-out operation.

When the handle 119 is pushed downwardly, the cover 117 in the upper part of the suction pipe 114 is opened, and at the same time the iron piece 120 of the lever 116 approaches the proximity switch 121, supplying the power to start the suction blower which is connected to the suction pipe 113.

With the start of the suction blower, the air is drawn in through the suction pipe 114, blowing the leading end of the yarn wound on the peg tray T into the core. At this time the length of the yarn to be blown in is determined by the operator.

After this leading-out operation, the operator pulls up the handle 119 to stop the suction blower. The length of time of operation required of the suction blower is about one-twentieth of the whole time of operation of the doubler. Therefore it is possible to save a great deal of energy by driving the suction blower only when needed.

After the suction blower is stopped, the feed yarn package E is moved to the D position.

However, between the conveyor 4 and the spindle-side rear conveyor 2, there is a stopper 124 fixedly mounted on one end of the swing arm 123 which is swingably supported on the support shaft 122 and pressed in the counterclockwise direction by the spring 125.

The operator, therefore, lowers this stopper 124 by hand to move the feed yarn package E to the D position.

There may be provided two sets of manually-operated drawing devices per spindle, or one set per spindle, or one set per two spindles.

Numeral 126 denotes free rollers used for the smooth movement of the tray T.

The feed yarn package conveyor system according to this embodiment of the present invention, having the constitution as described above, has the following advantages.

Since there is no necessity of using a very large automatic yarn end drawing device, the floor space can be saved. In addition, the conveyor is applicable where types of yarns are frequently changed and also where various types of feed yarn packages are used.

Furthermore, since the suction blower for leading out a yarn end is operated only when required, a great deal of power required can be saved.

It will be described a lower yarn drawing device of a doubler for drawing out lower yarns from feed yarn packages supported in a lower part of said doubler to piece up the lower yarns with an upper yarn on a take-up package.

In conventional doubler, there are arranged a plurality (e.g., two) of feed yarn packages in the lower part thereof, such that yarns led out from these packages are converged into one yarn to be taken up by a take-up package located in the upper part of the machine.

In taking-up operation, the lower yarn will sometimes run out or will be broken. When the lower yarn has been all fed out, the feed yarn package will be replaced and a yarn led out from a new package will be pieced up with the upper yarn on the take-up package. Also in the event of yarn breakage, the lower and upper yarns will be pieced up.

In conventional doublers the drawing out and piecing of the yarns are done manually. For the purpose of improving this operation, the application of an automatic piecing technology in an automatic winder to this doubler has been attempted.

However, since the doubler, unlike an automatic winder, has a plurality of feed yarn packages, it is impossible to adopt the automatic piecing technology of the automatic winder and accordingly it is difficult to lead out the lower yarns from these feed yarn packages.

The embodiment of present invention has been accomplished in an attempt to solve the problem described above and provides a lower yarn drawing device of a doubler which is capable of easily drawing out the lower yarn from a plurality of feed yarn packages.

The lower yarn drawing device of the doubler according to the embodiment of the present invention comprises a lower yarn blowing-up section located in the feed yarn package support section; a hood branched off for catching yarns being blown upwardly from both the feed yarn packages, and converging upwardly; and a suction mouth removably connected to the converging section of the hood, for guiding the yarns to a piecing device.

At the time of yarn piecing, the lower yarn blowing-up section is operated to blow up the lower yarn from a new feed yarn package or a broken yarn. At the same time, the suction mouth is operated for connection to the converging section of the hood to inhale the yarn up into the hood.

The lower yarn fed out from the feed yarn package is caught in the branched hood and joined into one yarn at the converging section, being drawn into the suction mouth. Therefore, the suction mouth is able to guide the lower yarn in a single line into the yarn piecing device, where the lower yarn is automatically pieced up with the upper yarn of the take-up package.

Hereinafter one embodiment of the present invention will be described in detail with reference to the accompanying drawings.

Figure 8:
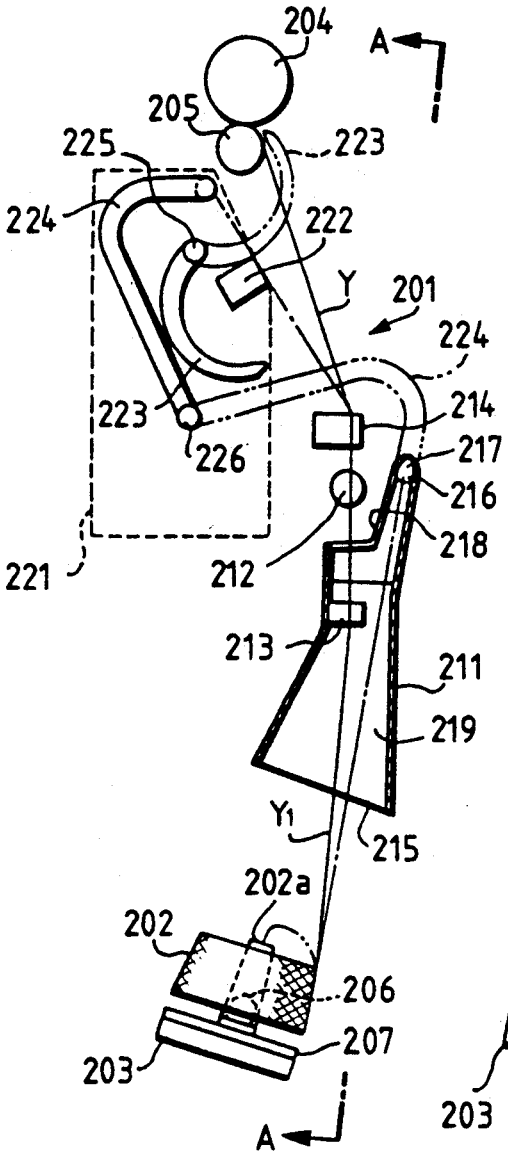
FIG. 8 is a side sectional view showing one embodiment of a lower yarn drawing device of a doubler according to the present invention.
Figure 9:
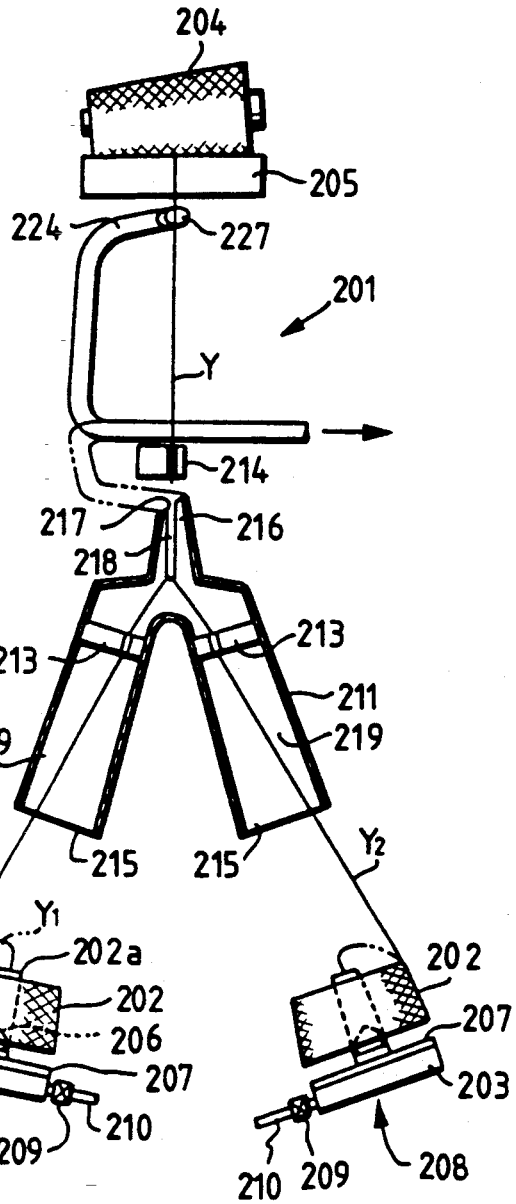
FIG. 9 is a sectional view taken along line A—A of FIG. 8.

In FIGS. 8 and 9, numeral 201 denotes doubling units. A plurality of the doubling units 201 are arranged laterally. Each unit 201 has, in the lower part, two support sections for supporting two feed yarn packages 202 and, in the upper part, a cradle (not illustrated) for rotatably holding one take-up package 204 and a driving drum 205 for turning the take-up package 204. In this unit 201, yarns Y1 and Y2 drawn out from the feed yarn packages 202 are doubled, being taken up by the take-up package 204.

The feed yarn package 202 described above is inserted upright on a carrying tray having a peg 206 at center. This tray 207 is provided with a through hole formed vertically through the peg 206. The aforesaid support section 203 of the feed yarn package is designed to support the feed yarn package 202 and the tray 207 together.

In each support section 203 is provided a lower yarn blowing-up section 208 which blows the leading ends of the lower yarns Y1 and Y2 of the feed yarn packages 202 upwardly. To constitute this lower yarn blowing-up section 208, the support section 203 is built in the form of a hollow box having a communication port not illustrated which is connected with the through hole of the tray 207, and is connected with a pressure air supply tube 210 through a solenoid valve 209. Therefore, when the solenoid valve 209 is opened, the pressure air is injected into the bobbin 202*a* shaft hole of the feed yarn package 202, thus blowing upwardly the leading end of the lower yarns Y1 and Y2 inserted in the bobbin shaft hole as indicated by a dotted line. The support sections 203 are inclined such that the lower yarns Y1 and Y2 being blown upwardly will meet at one point.

Along a yarn path (Y) going upwardly from the feed yarn package 202 to the take-up package 204 is installed a bifurcated hood 211 which is branched off towards the feed yarn packages 202 and converges upwardly. Above this hood 211 are mounted, in order of mention, a tenser 212 for maintaining, at a constant tension, the doubled yarn to be taken up by the take-up package 204 and a cutter 214 for cutting the yarn in accordance with a yarn cutting signal from a sensor 213 described later.

The branched lower ends of the hood 211 open as inlet ports 215. An upper end (a converging section) 216 is formed projecting in a tubular form and shifted forwardly of the yarn path (Y). At this converging section 216 is formed a connecting port 217 which is cut diagonally to facilitate removably connecting the suction mouth 224 described later. The hood 211 has a slit 218 communicating with the yarn path (Y) through the connecting port 217.

Inside the branch passages 219 of the hood 211 are installed feelers or sensors 213 for sensing the absence or breakage of the lower yarns Y1 and Y2. The cutter 214 will operate in accordance with the signal sensed. Also, the solenoid valve 209 mounted on the corresponding side is operated to open in accordance with the signal sensed by the sensor 213, and at the same time produces a command signal for yarn piecing.

Behind the yarn path (Y) is supported a yarn piecing dolly 221, which travels along the direction of arrangement of the unit 201, for piecing up the upper yarn Y of the take-up package 204 which has been cut by the cutter 214, with the lower yarns Y1 and Y2 of the feed yarn packages 202. This yarn piecing dolly 221 is designed to stop for piecing up the yarns in the unit position in accordance with the yarn piecing command signal previously stated. This dolly has a piecing device 222 for piecing up the yarns by utilizing a whirling air stream, and suction mouths 223 and 224 for guiding the upper yarn Y and the lower yarns Y1 and Y2 into the yarn piecing device. This yarn piecing device 222 may be a known piecing device, or may be such a device that the upper yarn Y and the lower yarns Y1 and Y2 are separated by each component yarns (two yarns each) and pieced up separately.

The upper yarn suction mouth 223 turns on the center of a support shaft 225 from the stowage position thereof on the yarn piecing dolly 221 side to the vicinity of the driving drum 205 to inhale the upper yarn Y, guiding the upper yarn Y to the yarn piecing device 222 when turning back to the stowage position. In the meantime, a suction port 227 of the lower yarn suction mouth 224 is cut obliquely so as to be connected to the connecting port 217 of the hood 211. The lower yarn suction mouth 224 is designed to turn on the center of the support shaft 226 from the stowage position on the yarn piecing dolly 221 side to the hood 211 side, thus connecting the suction port 227 to the connecting port 217 of the hood 211 to inhale the lower yarns Y1 and Y2 from the hood 211 and guiding the lower yarns Y1 and Y2 into the yarn piecing device 222 when returning to the stowage position.

The lower yarn drawing device of the doubler is made up of the lower yarn blowing-up section 208, the hood 211 and the lower yarn suction mouth 224.

Next the operation of the embodiment according to the present invention will be described.

When the lower yarn Y1, Y2 of either or both of the feed yarn packages 202 has been fed all out, the sensor 213 senses the empty package, producing a signal. The cutter 214 and the solenoid valve 209 located on the corresponding side are operated in accordance with this signal and at the same time a yarn piecing command signal is issued. At this time the unit 201 stops taking up the yarn.

The empty feed yarn package 202 is then replaced with a new package with the yarn end inserted in the bobbin 202*a* shaft hole. And when the solenoid valve 209 is operated to open, the leading end of the lower yarn (e.g., Y1) is blown upwardly with the pressure air jetted out from the through hole of the tray 217 into the bobbin 202*a* shaft hole via the support section 203. The upper yarn Y cut by the cutter 214 is taken up on the take-up package 204 which is rotating with an inertia force, while the lower yarn Y2 of the feed yarn 202 which has not been replaced will be properly tensioned by the tenser 212 after cutting.

The yarn piecing dolly 221 traveling around along the unit 201 stops in the unit position in accordance with the yarn piecing command signal previously stated, starting piecing the yarns. First, the upper yarn suction mouth 223 turns to inhale the upper yarn Y from the take-up unit 204 to the yarn piecing device 222. During the operation of this upper yarn suction mouth 223, the driving drum 205 turns reversely to assist in drawing out the upper yarn Y.

Next, the lower yarn suction mouth 224 turns to connect the suction port 227 to the connecting port 217 of the hood 211, for inhaling in the hood 211. When this lower yarn suction mouth 224 approaches the hood 211, the tenser 212 opens to release the lower yarn Y2. The lower yarn suction mouth 224 inhales the lower yarn Y2 released from the tenser 212 and, at the same time, inhales the lower yarn 201 that has been blown upwardly from the new package and caught in the hood 201 by the suction air stream, the lower yarns Y1 and Y2 being guided into the yarn piecing device 222. At this time the lower yarns Y1 and Y2 move from the connecting port 217 into the slit 218, and the tenser is closed to hold these lower yarns Y1 and Y2. The upper yarn Y and the lower yarns Y1 and Y2 that have been guided into the yarn piecing device are pieced by this yarn piecing device 222. When the piecing has been completed, the unit 201 restarts taking up the yarns, and the yarn piecing dolly 221 restarts running.

Meanwhile, in the event of breakage of either of the lower yarns Y1 and Y2 in the course of taking-up operation, piecing is performed in a similar manner. In this case, no yarn replacement is performed; the lower yarn Y1 that has been broken is being blown upwardly into the hood 211 by the pressure air jetted out through the solenoid valve 209 which is open. This lower yarn Y1 and the lower yarn Y2 which has been cut by the cutter 214 are guided into the yarn piecing device by the lower yarn suction mouth 224.

In this manner the lower yarns Y1 and Y2 are blown upwardly from a plurality of feed yarn packages and at the same time the suction mouth 224 is connected to the converging section 216 of the hood 211, thus drawing the air in the bifurcated hood 211 to trap these lower yarns Y1 and Y2 in this hood 211. These yarns Y1 and Y2 are doubled into a single line at the joint section and led to the yarn piecing device 222 by means of the suction mouth 224. Therefore, it is possible to replace the feed yarn or to easily draw a broken one of the lower yarns Y1 and Y2 of the feed yarn packages 202, thereby enabling automatic piecing of yarns.

In the embodiment described above, the lower yarn drawing device having a couple of feed yarn packages 202 has been explained. A device having three feed yarn packages or more can obtain a similar effect; the lower part of the hood 211 is branched off in accordance with the number of packages. In the embodiment described above, piecing of each unit 201 is performed by the use of a common yarn piecing dolly 221. Each unit 201 is equipped with the yarn piecing device 222 and the suction mouths 223 and 224 for individual piecing of yarns.

According to the embodiment of the present invention, lower yarns are blown upwardly from a plurality of feed yarn packages and at the same time the suction mouth is connected to the converging section of the hood to inhale in the hood interior, thus catching the lower yarns in the branched hood to double the yarns into a single line at the converging section. The single yarn thus made is then led into the yarn piecing device. Therefore it is possible to easily draw out the lower yarns from the feed yarn packages that have been replaced or that have been broken, thereby enabling automatic yarn piecing.

What is claimed is:

1. A apparatus for conveying yarn packages to and from a winder, the winder having first and second sides, the apparatus comprising:

package supply means for supplying packages to the first and second sides of the winder, the package supply means arranged at a predetermined angle, the predetermined angle being inclined relative to a horizontal plane;

package discharge means, arranged at an angle substantially equal to the predetermined angle, for discharging packages from the first and second sides of the winder;

a first conveyor arranged adjacent the package supply means at an angle substantially equal to the predetermined angle; and a second conveyor arranged substantially between the first conveyor and the package discharge means at an angle substantially equal to the predetermined angle, the second conveyor adapted to tilt towards the winder.

2. The apparatus of claim 1, further comprising stop means for preventing package transfer from the second conveyor to the package discharge means.

3. The apparatus of claim 1, further comprising: stop means for preventing package transfer from the first conveyor to the second conveyor.

4. The apparatus of claim 3, wherein the stop means comprises an arm having first and second end portions, the arm being pivotably mounted substantially below the first and second conveyors such that when the first end portion is actuated the second end portion prevents advancement of a package.

5. The apparatus of claim 4, wherein the first and second end portions comprise rollers.

6. The apparatus of claim 1, further comprising stop means for preventing package transfer from the package supply means to the first conveyor.

7. The apparatus of claim 6, wherein the stop means comprises an arm having first and second end portions, the arm being pivotably mounted substantially below the package supply means and the conveyor means such that when the first end portion is actuated the second end portion prevents the advancement of a package.

8. The apparatus of claim 7, wherein the first end portion comprises a roller.

9. The apparatus of claim 6, wherein the stop means further comprises transfer means for transferring a package from the package supply means to the conveyor means when the second end portion is depressed.

10. The apparatus of claim 1, wherein the first conveyor is rigidly fixed in place such that it may not be tilted towards the winder.

11. A device for doubling yarn, comprising:

doubling means for doubling yarn wound from first and second yarn packages, the doubling means having first and second sides and a yarn converging point; and first and second conveyors arranged for conveying the first and second yarn packages to an unwinding station along paths substantially adjacent to the first and second sides, respectively, each of the first and second conveyors including first and second conveying portions, each of the second conveying portions comprising tilting means for tilting packages toward the yarn converging point and for tilting packages away from the yarn converging point;

whereby the packages are tilted towards the yarn converging point during unwinding.

12. The device of claim 11, wherein the each of the second conveying portions further comprises a rotatably mounted guide plate and the tilting means comprises rotation means for rotating the guide plates.

13. The device of claim 11, wherein the first conveying portion is rigidly fixed in place such that it may not be tilted towards the converging point.

* * * * *